US005573152A

United States Patent [19]

Arnold

[11] Patent Number: 5,573,152

[45] Date of Patent: Nov. 12, 1996

[54] BOTTLE STRAP

[76] Inventor: Jamie Arnold, 4 Roven Rd., Wesley Hills, N.Y. 10952-1117

[21] Appl. No.: 195,653

[22] Filed: Jan. 24, 1994

[51] Int. Cl.[6] ..... A45F 5/00

[52] U.S. Cl. ..... 224/148.4; 224/674; 224/249; 215/399

[58] Field of Search ..... 224/148, 252, 224/253, 249, 148.4, 674; 294/31.2; 215/100 A

[56] References Cited

U.S. PATENT DOCUMENTS

| | | | |
|---|---|---|---|
| 2,781,960 | 2/1957 | Dick | 215/100 A |
| 3,463,536 | 8/1969 | Updegraff et al. | 275/100 A |
| 3,709,544 | 1/1973 | Oltmanns | 294/31.2 |
| 4,631,783 | 12/1986 | Hayashi | 211/70.6 |
| 4,730,728 | 3/1988 | Larkin | 224/252 |
| 5,203,481 | 4/1993 | Dobbins et al. | 224/148 |
| 5,301,857 | 4/1994 | Green | 224/252 |

*Primary Examiner*—Linda J. Sholl

[57] ABSTRACT

A bottle strap is adapted to detachable engagement with the neck of a bottle. The neck has a bottle neck ring with a neck region disposed below the ring. The strap is a flat elongated flexible thin member having two opposite ends with an enlargement at one end. The enlargement has an opening therein. The opening has a serrated periphery and is adapted to be snap fitted over the bottle neck ring so that the enlargement is firmly secured to the neck region, the other end of the member being adapted to detachably engage the member at a position intermediate its ends, thereby forming a closed loop.

3 Claims, 1 Drawing Sheet

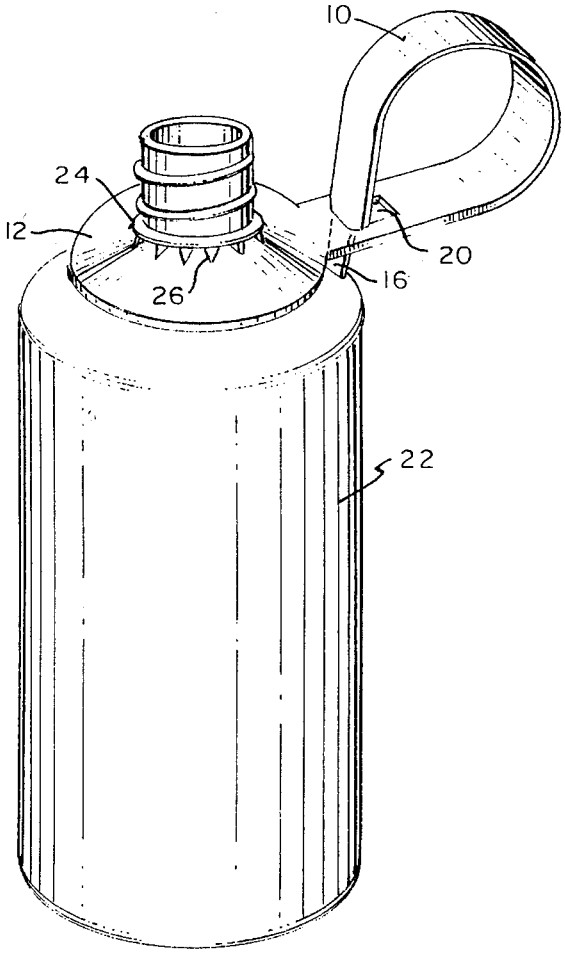
FIG. 3
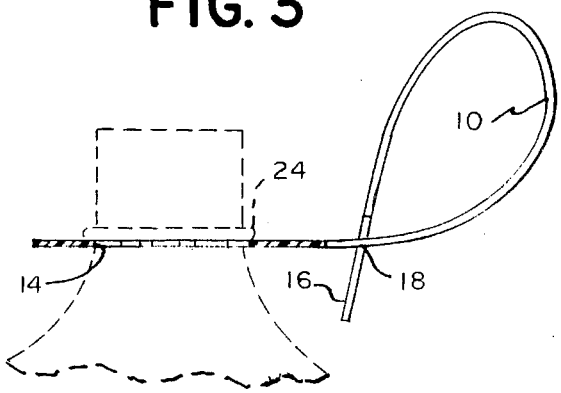
FIG. 4
FIG. 1
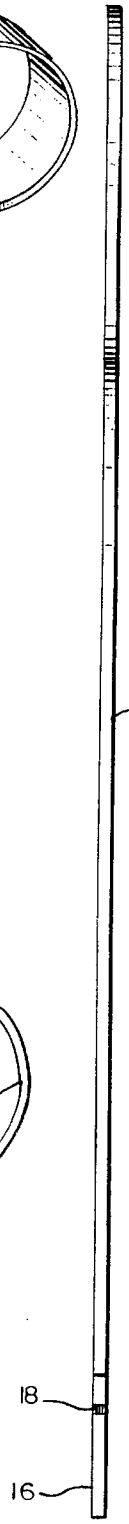
FIG. 2
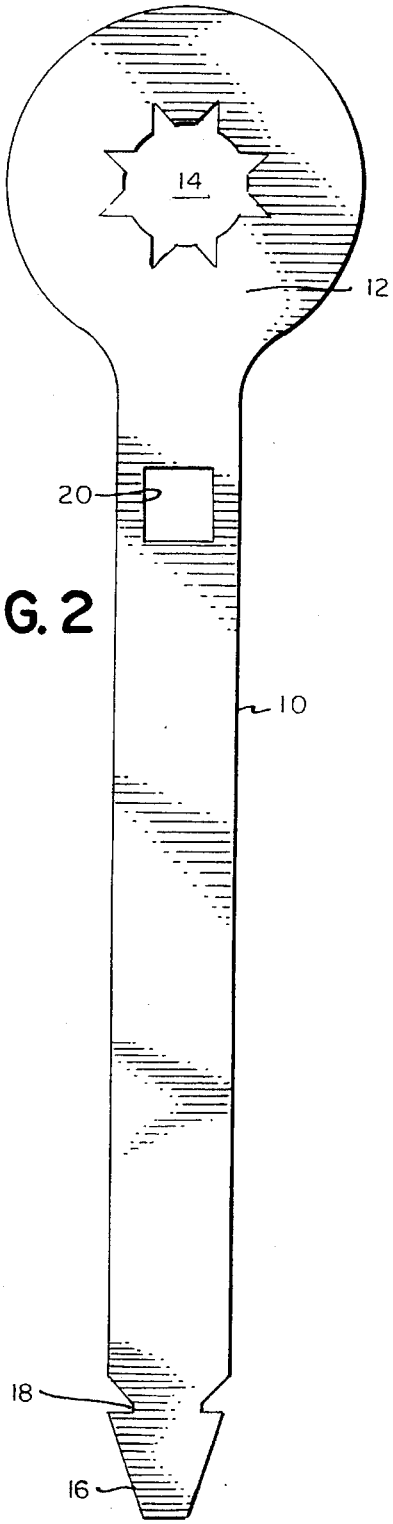

BOTTLE STRAP

BACKGROUND OF THE INVENTION

Individuals and groups engaged in hiking, cycling and other athletic activities often carry containers of liquids. These containers take various forms and are often detachably secured by straps or other means to knapsacks, belts, handle bars or the like.

These containers and straps or other means are expensive and non-disposable. The present invention is directed toward a new and inexpensive bottle strap which can be used in conjunction with disposable plastic or glass soda or water bottles or the like as a complete replacement for known containers and detachable securing means.

SUMMARY OF THE INVENTION

It is an object of the present invention to provide a new type of bottle strap which can be secured to a disposable bottle in such manner as to replace permanent non disposable containers and detachable supporting means as used by individuals or groups engaging in athletic activities.

Another object of this invention is to provide a new type of bottle strap of the character indicated which is inexpensive and disposable.

These and other objects and advantages of the invention will either be explained or will become apparent hereinafter.

In accordance with the principles of this invention, a bottle strap is adapted for detachable engagement with the neck of a bottle. This neck has a bottle neck ring with a neck region disposed below the ring.

The strap takes the form of a flat elongated flexible thin member having two opposite ends with an enlargement at one end.

The enlargement has an opening therein. The opening has a serrated periphery and is adapted to be snap fitted over said bottle neck ring so that the enlargement is firmly secured to said neck region.

The other end of the member is adapted to detachably engage the member at a position intermediate its ends, thereby forming a closed loop through which a belt, handle bars, knapsack loops or the like can extend.

The member typically is formed from inexpensive high density polyethylene and the bottle can be an empty soda bottle or the like. Hence the entire structure is inexpensive and can even be disposed of and replaced at minimum expense.

BRIEF DESCRIPTION OF THE DRAWINGS

FIG. 1 is a plan view of a preferred embodiment of the invention.

FIG. 2 is a side view of the structure shown in FIG. 1.

FIG. 3 is a perspective view showing the embodiment as secured to a bottle and ready for use.

FIG. 4 is a detail side view of the structure shown in FIG. 3.

DETAILED DESCRIPTION OF PREFERRED EMBODIMENT

Referring now to FIGS. 1–4, there is shown a flexible flat member 10 formed from high density polyethylene. The member can be about ten and seven eighths inches long, about thirteen sixteenths of an inch wide and about one sixteenth of an inch thick. The member has two opposite ends.

One end is an enlargement 12, typically of circular shape about two and seven sixteenths in diameter. This end has a first opening 14 which has a serrated periphery. Typically, the first opening is an octagonal cut out of fifteen sixteens of an inch diameter and employing a triangular cut out of four sixteenths of an inch where each of the connecting points of the octagon meet. This forms a "sun burst" shaped cut out which is centered in enlargement 12.

The other end of the member can be detachably secured to the member at a position intermediate its ends. In this embodiment, the other end has a notched pointed tip 16. The tip can start at a width of one quarter of an inch and flare out to three quarters of an inch. The length of the pointed tip can be eleven sixteenths of an inch long, immediately followed by a cut out 18 at each end of the strap. Each cut out can be one quarter inch in length and can have a triangular shape. The distance between the end of these notches and the point of connection of the narrow portion of the member to the enlargement can be about seven and one sixteenth inches.

The member contains a second opening 20 which can be a rectangular opening about eight sixteenths of an inch wide and about nine sixteenths of an inch in length, the length extending along the length of the member. The opening 20 is centered in the member and can be disposed so that the edge closest to the enlargement is disposed about eleven sixteens of an inch past the point of connection of the narrow portion of the member to the enlargement.

A disposable empty plastic soda bottle 22 has a neck with a thread adapted to detachably receive a metal or plastic cap [not shown]. The neck disposed below the thread has an enlarged outwardly extending bottle neck ring 24 which extends outwardly beyond the thread and has a neck portion 26 disposed therebelow.

In use, the enlargement opening is snap fitted onto the neck below the ring 24. Due to the flexibility of the serrations or sun burst, the triangular cut outs bend inward to allow the opening to fit over the ring and then these cut outs return to their original position to firmly attach the enlargement to the bottle.

The opposite end is then looped over the remainder of the member and inserted in the second opening 20 so that the notches firmly engage the opposite edges of this opening. This action forms a closed loop 26 through which a belt or the like can extend in the manner previously described.

While the invention has been described with particular reference to the preferred embodiment, the protection solicited is to be limited only by the terms of the claims which follow.

What is claimed is:

1. A bottle strap adapted for detachable engagement with the neck of a bottle, said neck having a bottle neck ring with a neck region disposed below the ring, said strap comprising:

a flat elongated flexible thin member having two opposite ends with an enlargement at one end, the enlargement having an opening therein, the opening having a serrated periphery defining a sunburst shape and being adapted to be snap fitted over said bottle neck ring so that the enlargement is firmly secured to said neck region, the other end of the member being adapted to detachably engage said member at a position intermediate its ends, thereby forming a closed loop.

2. A bottle strap adapted for detachable engagement with the neck of a bottle, said neck having a bottle neck ring with a neck region disposed below the ring, said strap comprising:

a flat elongated flexible thin member having two opposite ends with an enlargement at one end, the enlargement having a first opening therein, the first opening having a serrated periphery defining a sunburst shape and being adapted to be snap fitted over said bottle neck ring so that the enlargement is firmly secured to said neck region, said member having a second opening disposed between the ends of the member, the other end of the member being adapted to detachably engage said second opening, thereby forming a closed loop.

3. The strap of claim 2 wherein the other end has inwardly extending notches which receive and hold peripheral edges of the second opening.

* * * * *